US008002529B2

(12) United States Patent
Koromilas

(10) Patent No.: US 8,002,529 B2
(45) Date of Patent: Aug. 23, 2011

(54) SCROLL COMPRESSOR WITH EXTENDED PROFILE

(75) Inventor: Constantinos A. Koromilas, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 333 days.

(21) Appl. No.: 12/196,473

(22) Filed: Aug. 22, 2008

(65) Prior Publication Data

US 2010/0047101 A1 Feb. 25, 2010

(51) Int. Cl.
*F03C 2/00* (2006.01)
*F03C 4/00* (2006.01)
*F04C 18/00* (2006.01)

(52) U.S. Cl. ..... 418/55.2; 418/15; 418/55.1

(58) Field of Classification Search ..... 418/55.1–55.6, 418/57, 178, 179, 15, 270
See application file for complete search history.

(56) References Cited

U.S. PATENT DOCUMENTS

| | | | |
|---|---|---|---|
| 1,378,065 | A | 5/1921 | Varley |
| 3,062,022 | A | 11/1962 | Averill |
| 3,999,904 | A | 12/1976 | Raymond |
| 4,527,964 | A | 7/1985 | Mitsu |
| 4,606,711 | A | 8/1986 | Mitusi |
| 5,547,353 | A | 8/1996 | Yamaguchi |
| 5,938,417 | A | 8/1999 | Takao |

*Primary Examiner* — Theresa Trieu

(57) ABSTRACT

A scroll type compressor, according to the invention, comprises first and second scroll members each having an end plate and a scroll wall projecting from the end plate. The scroll members have their scroll walls interleaved with one another to define therebetween a compression chamber and upon relative orbiting movement between the scroll members the compression chamber migrates to compress a compressible medium. The scroll walls are each comprised of a plurality of alternating straight line wall portions and circular arc portions. The straight line wall portions can be modified to house a catalyst or a fluid port. Or the straight line sections may be telescopically extendible in length to thereby adjust the displacement of the compressor.

13 Claims, 3 Drawing Sheets

SCROLL COMPRESSOR WITH EXTENDED PROFILE

FIELD OF THE INVENTION

The present invention relates to a scroll type compressor in which first and second scroll members are interleaved with one another defining a compression chamber wherein a fluid is compressed.

BACKGROUND OF THE INVENTION

It is known to provide a scroll type compressor in which first and second scroll members are interleaved with one another to define therebetween a compression chamber which encloses a pocket of compressible fluid. The scroll members may have the shape of a circular involute or an Archimedean spiral. Synchronized motion between the scroll members will compress the fluid therebetween as the fluid progresses between an inlet and an outlet. Most often one of the scroll members is fixed while the other scroll member orbits about the fixed scroll member using an Oldham coupling or other drive mechanism. Alternatively, both of the scroll members can rotate. Scroll compressors, are most often used to compress air or refrigerant or exhaust gases. A scroll compressor can be orbited in the opposite direction to operate as a vacuum pump or other fluid expanding device.

The spiral shape of the scroll members is generally complex to manufacture and requires complicated machine processes.

It would be desirable to provide a scroll compressor having scroll members of simpler shapes which would be relatively easier to machine.

And it would also be desirable to provide a scroll compressor for performing functions not heretofore known in the prior art.

SUMMARY OF THE INVENTION

A scroll type compressor, according to the invention, comprises first and second scroll members each having an end plate and a scroll wall projecting from the end plate. The scroll members have their scroll walls interleaved with one another to define therebetween a compression chamber and upon relative orbiting movement between the scroll members the compression chamber migrates to compress a compressible medium. The scroll walls are each comprised of a plurality of alternating straight line wall portions and circular arc portions. The straight line wall portions can be modified to house a catalyst or a fluid port. Or the straight line sections may be telescopically extendible in length to thereby adjust the displacement of the compressor.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully apparent from the detailed description and the accompanying drawings, wherein.

DETAILED DESCRIPTION OF THE EXEMPLARY EMBODIMENTS

The following description of certain exemplary embodiments is exemplary in nature and is not intended to limit the invention, its application, or uses.

Figure 1:
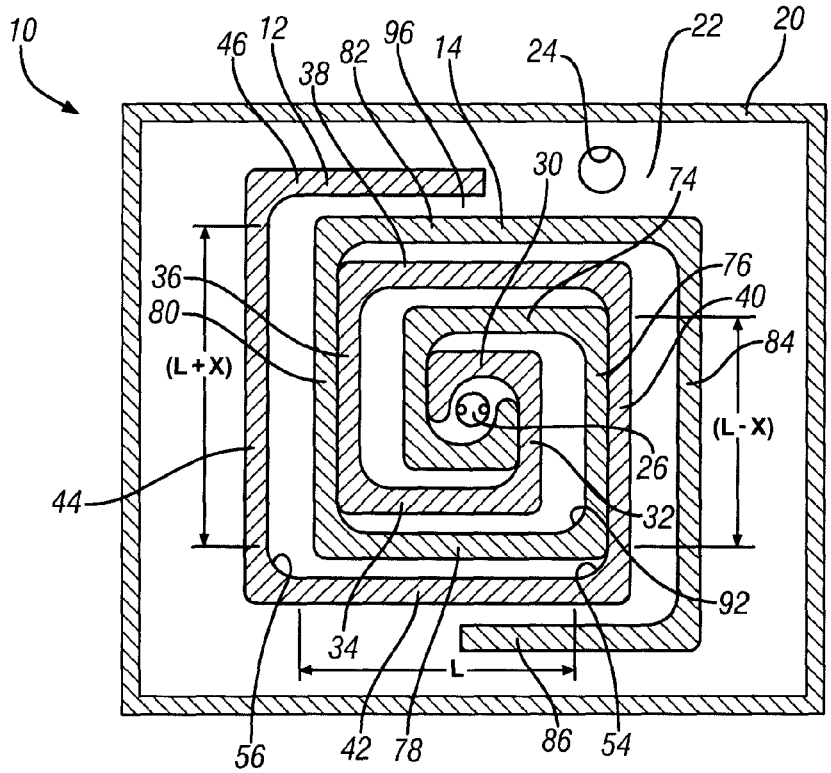
FIG. 1 is a section view taken through the scroll compressor of the invention and showing interleaved scroll walls of a generally square shape.

Referring to FIG. 1, a scroll type compressor generally indicated at 10 includes a first scroll member 12 and a second scroll member 14 that are interleaved together. The first scroll member 12 rises from an end plate 18. The end plate 18 is bounded by an outer wall 20 that rises from the endplate 18 and provides an outer wall of a chamber 22 that serves as a sump for the compressible fluid. The sump 22 has an inlet 24 provided in the end plate 18. In addition, the end plate 18 has an outlet 26 that is located in the center of the end plate 18.

As seen in FIG. 1 the outer scroll member 12 has a spiraling wall shape that is comprised of a plurality of straight line wall portions 30, 32, 34, 36, 38, 40, 42, 44, and 46. Each of these straight line wall portions is joined by a circular arc. For example, arc 54 connects the straight line wall portions 40 and 42, and circular arc 56 connects the straight line wall portions 42 and 44. Each of the arcs of the first scroll member 12, including arcs 54 and 56, have an equal radius, and the circular arcs each subtend an angle of 90 degrees. Thus, the straight line wall portions 40 and 42 are at right angles to one another. Likewise the straight line wall portions 42 and 44 are also at right angles to one another. The straight line wall portion 40 is parallel with the straight line wall portion 44. In addition, it is seen that each of the straight line wall portions differs from the length of an adjacent straight line wall portion by a constant difference, for example the straight line wall portion 42 has a length designated L, the adjacent straight line wall portion 40 has a length of L−X, and the adjacent straight line wall portion 44 has a length equal to L+X.

The second scroll member 14 is a mirror image of the scroll member 12 including straight line wall portion 70, 72, 74, 76, 78, 80, 82 and 84 that are connected by circular arc wall portions. For example the straight line wall portion 76 is connected to the straight line wall portion 78 by an arc 92 which subtends 90 degrees so that the straight line wall portions 76 and 78 are at right angles to one another.

The first scroll member 12 and its end plate 18 are preferably fixed against movement while the second scroll member 14 and its end plate, not shown, is orbited in the counterclockwise direction as viewed in FIG. 1 so that compressible fluid is drawn from the sump 22 into an inlet 96 that is formed between the first scroll member 12 and the second scroll member 14. As the second scroll member 14 orbits counterclockwise within the confines of the first scroll member 12, the fluid is progressively displaced into chambers of diminishing size so as to be compressed and then exit the scroll compressor through the outlet 26.

Thus, as seen in FIG. 1, the design of the scroll compressor to include alternating straight line wall portions and circular arc portions will simplify the machining and manufacture of the scroll members because straight lines and circular surfaces are easier to machine than other more complicated shapes such as circle involutes or Archimedean spirals commonly employed in scroll compressors.

Although referred to herein as a "compressor", it will be understood that the scroll compressor 10 can be run in the opposite direction to function as an expander, rather than as a compressor.

Figure 2:
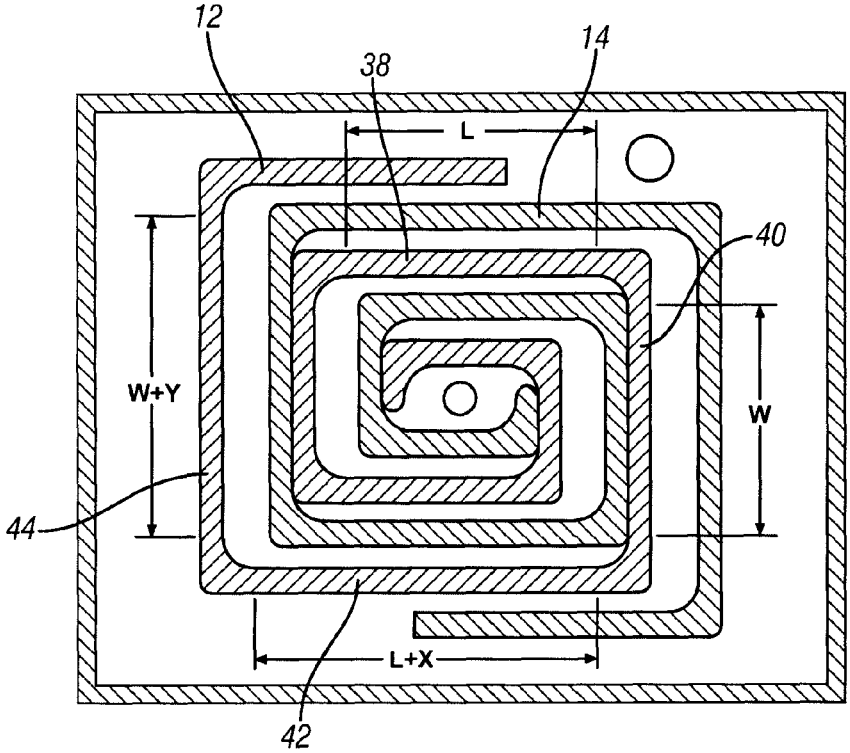
FIG. 2 is a view similar to FIG. 1 but showing a second embodiment of the invention in which the interleaved scroll walls are of a generally rectangular shape.

FIG. 2 shows another embodiment of the invention, generally similar to FIG. 1, and having like elements designated by like numerals. The difference in FIG. 2 is that the aspect ratio of the scroll compressor has been changed from the square shape of FIG. 1 to a rectangular shape of FIG. 2. In this rectangular shaped unit, the straight line wall portions alternate between being relatively long and relatively short. In particular, the first scroll member 12 has straight line wall portion 38 of length L, adjacent to straight line wall portion 40 of length W, which is adjacent to straight line wall portion 42 of length L+X, which is adjacent to straight line wall portion 44 of length W+Y. Accordingly, the scroll compressor has a more rectangular shape that may be advantageous in packaging the scroll compressor within the vehicle or other application.

Figure 3:
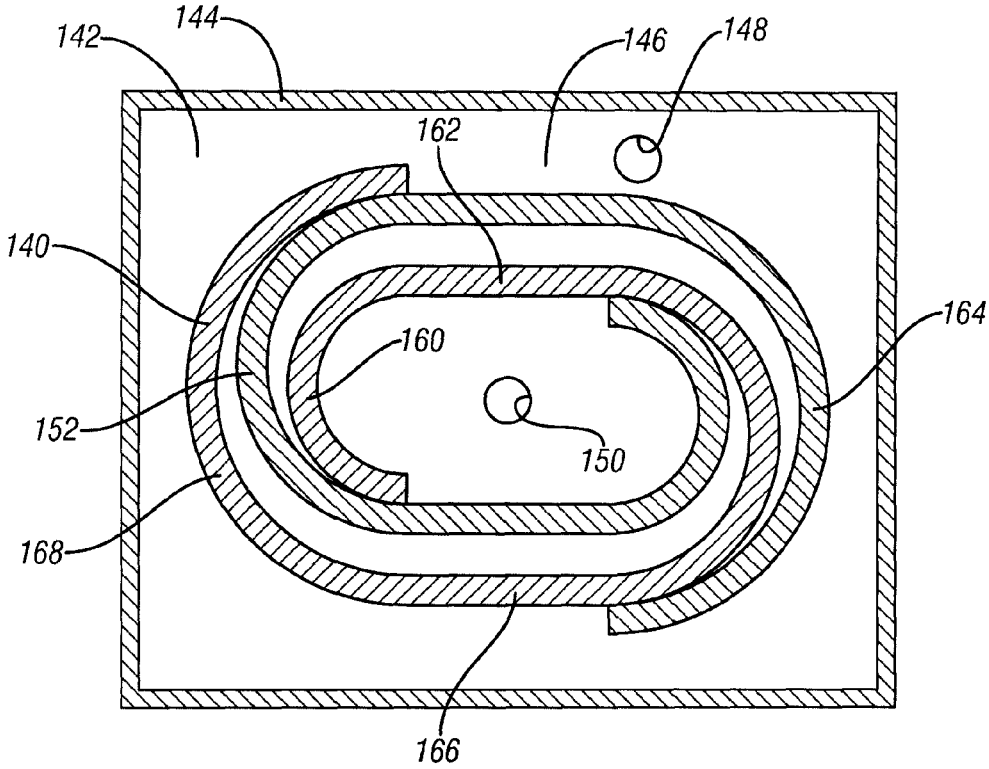
FIG. 3 is a view similar to FIG. 1 but showing a third embodiment of the invention in which the interleaved scroll walls are of a generally oval shape.

Referring to FIG. 3, another embodiment is shown in which the scroll members have a generally oval shape. In particular, a first scroll member 140 rises from a endplate 142 having an outer wall 144 that defines a sump 146 connected to inlet 148. The endplate 146 also has an outlet 150 generally in the center thereof. A second scroll member 152 is a mirror image of the first scroll member 140. The first scroll member 140 includes a 180 degree arc wall portion 160, adjacent to a straight line wall portion 162, adjacent a 180 degree arc wall portion 164, which is in turn adjacent a straight line wall portion 166, adjacent another 280 degree arc wall portion 168. Thus, as in the examples of FIGS. 1 and 2, the scroll members 140 and 152 are each comprised of alternating straight line wall portions and circular arc portions, although the scroll members are generally oval in shape as opposed to the square shape of FIG. 1 and rectangular shape of FIG. 2. The oval shape is provided by the fact that each of the circular arc portions subtend an angle of 180 degrees.

Figure 4:
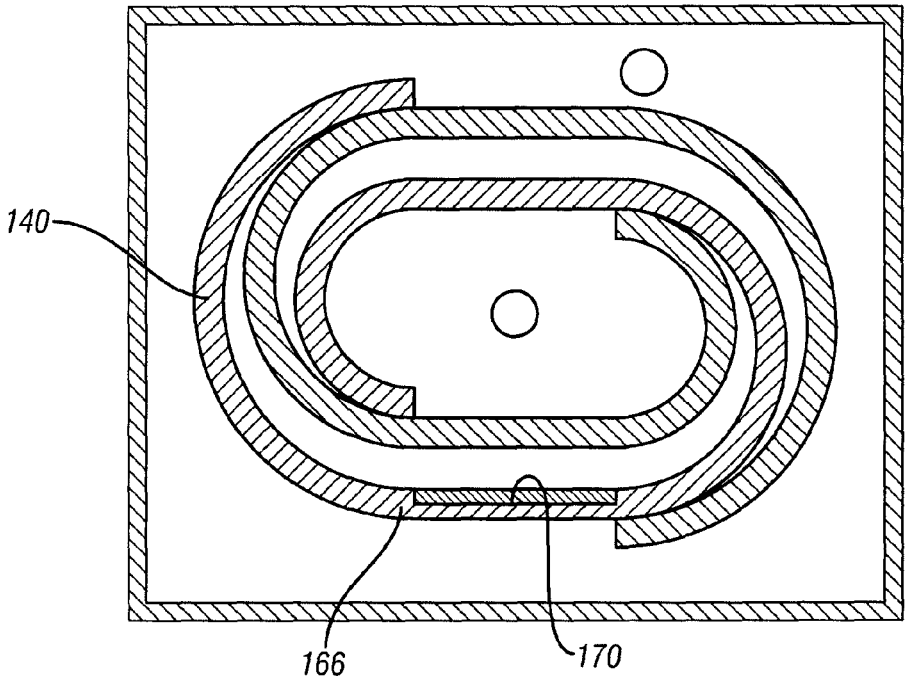
FIG. 4 is another view similar to FIG. 1 but showing an embodiment of the invention in which a catalyst chamber is provided in the wall of the scroll member.

FIG. 4 shows another embodiment of the invention generally similar to FIG. 3, and having like elements designated by like numerals. In the embodiment of FIG. 4, a recess 170 is provided in the straight line wall portion 166, and a catalyst material is mounted in the recess 170. For example, the scroll compressor of FIG. 4 may be used to expand exhaust gases extracting additional energy and the catalyst may be a substance for treating unwanted pollutants such as nitrous oxides, carbon monoxide, and/or hydrocarbons. The size and the depth of the recess 170 can be chosen to provide the desired extent of exposure between the catalyst and the compressible medium. The depth of the recess can exceed the dimension of the catalyst residing therein, thereby defining an expansion chamber so that a quantity of the compressible medium can be held in the recess for increasing the time of exposure of the compressible medium to the catalyst.

Figure 5:
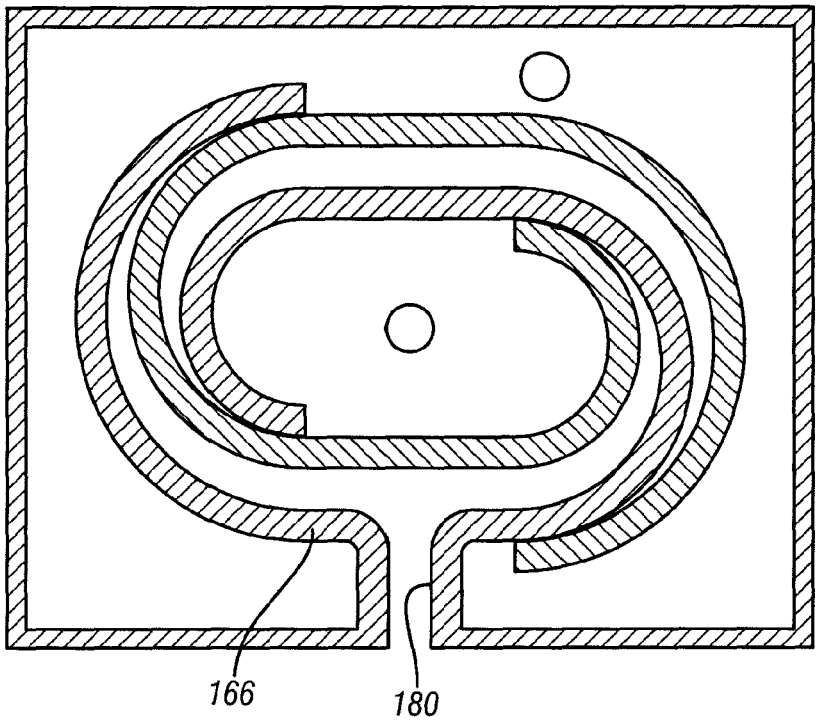
FIG. 5 is another view similar to FIG. 1 but showing an embodiment of the invention in which an auxiliary port is provided in the wall of the scroll member.

FIG. 5 shows another embodiment of the invention generally similar to FIG. 3, and having like elements designated by like numerals. In the embodiment of FIG. 5, an auxiliary port 180 is provided in the straight line wall portion 166 to modify the capacity or pressure of the scroll compressor. For example, the scroll compressor of FIG. 5 may be used to compress gases, and the auxiliary port 180 may be opened, fully or partly, to extract partially compressed gases, or to reduce the effective capacity of the compressor by bleeding away some of the output at an intermediate stage of the compression. In the case where the machine is reversed, and functions as an expander, this auxiliary port can be used to insert other gases at lower pressure.

Figure 6:
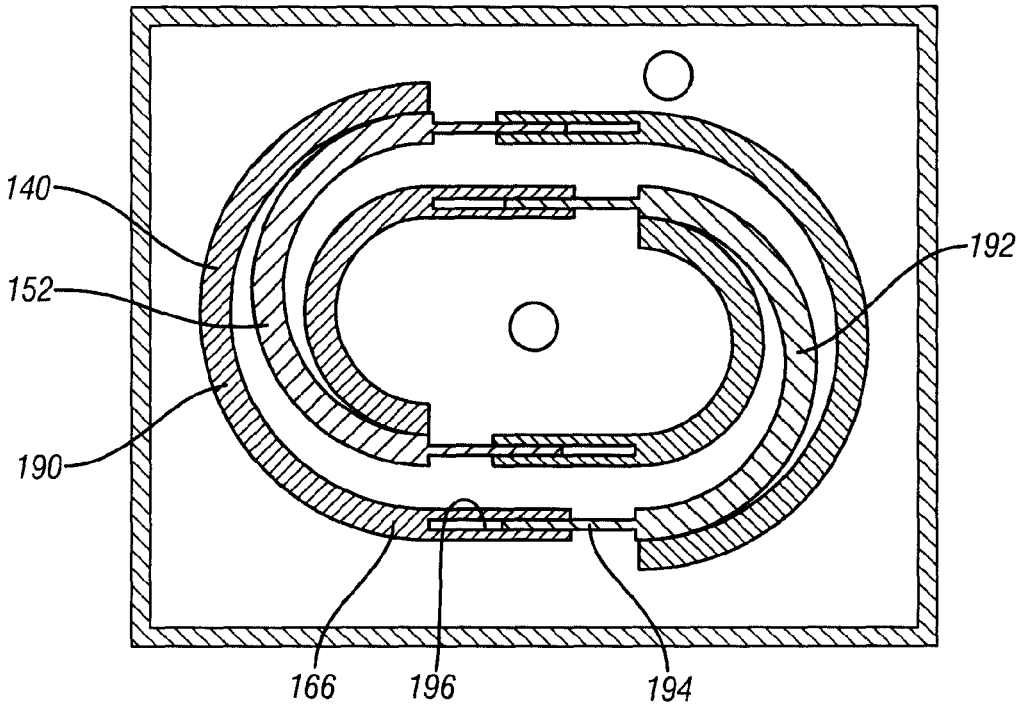
FIG. 6 shows yet another embodiment of the invention in which the straight line wall segments are telescopically extendible to enable variable displacement of the compressor.

FIG. 6 shows another embodiment of the invention generally similar to FIG. 3, and having like elements designated by like numerals. In the embodiment of FIG. 6, each of the straight line wall portions is modified to be extendible in length. In particular, in FIG. 6, the first scroll member 140 is a two-part construction that includes a left scroll half 190 and a right scroll half 192 that fit together in an extendible telescoping fashion. At the straight line wall portion 166, a male member 194 extending from the right scroll half 192 slides within a female slot 196 provided in the left hand scroll half 190. Similar extendible telescoping wall constructions are provided at each of the other straight line wall portions of the first scroll member 140. The extendible telescoping length of the straight line wall portions allows the shape of the scroll compressor to be adjusted as desired to modify the volumetric efficiency of the scroll compressor.

The description of the invention is merely exemplary in nature and, thus, variations thereof are intended to be within the scope of the invention. For example, it will be understood that the features of the various embodiments can be employed in various combination to provide a multi-functional scroll compressor. One example of such a multi-functional scroll compressor would be one that had both the catalyst of FIG. 4 and an auxiliary port as in FIG. 5.

In addition, it will be understood that the scroll compressor of this invention is not limited to the particular number of straight line and arc wall portions shown in the drawing examples. For example, although FIG. 1 shows a four-sided square, the scroll members of the scroll compressor can have a five-sided polygonal shape or a six-sided hexagonal shape. In the case of the five-sided, or pentagonal shaped scroll member, the straight line wall portions will intersect at curved wall portions that subtend an angle of 72 degrees. In the case of the six-sided scroll member, the scroll member will have the straight line wall portions intersect at circular wall portions that subtend an angle of 60 degrees. Also, in the case of the six-sided or hexagonal scroll member, the device can be stretched to have more of a rectangular shape similar to FIG. 2.

Therefore, in view of the foregoing description and drawings, it will be understood that the term "circular arc" as used herein means an unbroken part of the circumference of a circle, and excludes other arc shapes such as a part of a circle involute or Archimedean spiral, that fall within the broader definition of an arc, but are not a part of a circle. Thus a circular arc is a curved line surrounding a center point, every point of the curved line being an equal distance from the center.

What is claimed is:

1. A scroll type compressor comprising: first and second scroll members, each having an end plate and a scroll wall projecting from the end plate, said scroll members being interleaved with one another to define therebetween a compression chamber and upon relative orbiting movement between the scroll members the compression chamber migrates to compress a gas or fluid medium; said scroll walls each being comprised of a plurality of alternating straight line wall portions and circular arc portions so that each straight line wall portion is between two circular arc portions and each circular arc portion is between two straight line wall portions.

2. The scroll compressor of claim 1 further comprising the scroll member having a generally square or rectangular shape with each circular arcuate portion subtending a 90 degree arc.

3. The scroll compressor of claim 1 further comprising the scroll member having a generally oval shape with each circular arcuate portion subtending a 180 degree arc.

4. The scroll compressor of claim 1 further comprising the scroll member having a generally pentagonal shape with each circular arcuate portion subtending a 72 degree arc.

5. The scroll compressor of claim 1 further comprising the scroll member having a generally hexagonal shape with each circular arcuate portion subtending a 60 degree arc.

6. The scroll compressor of claim 1 further comprising at least one of the straight line wall portions of a least one of the scroll members having a recess therein in which a catalyst material resides for treatment of the compressible medium during the compression or expansion thereof.

7. The scroll compressor of claim 6 further comprising said recess having a greater size than the size of the catalyst material so that the compressible medium expands into contact with the catalyst material.

8. The scroll compressor of claim 1 further comprising each of said scroll members having a first scroll half and a second scroll half, and each of the scroll halves having the straight line wall portions thereof provided with a male member on one of the scroll halves that slides within a female slot of the other scroll half so that each of the opposing straight line wall portions is telescopically extendible in length so that the shape of the scroll members is extended in length.

9. The scroll member of claim 1 further comprising an auxiliary port provided in at least one of the straight line wall portions to enable the introduction or withdrawal of compressible medium or other materials.

10. A scroll type compressor comprising: first and second scroll members, each having an end plate and a scroll wall projecting from the end plate, said scroll members being interleaved with one another to define therebetween a compression chamber and upon relative orbiting movement between the scroll members the compression chamber migrates to compress a gas or fluid medium; said scroll walls each being comprised of a plurality of alternating straight line wall portions and circular arc portions so that each straight line wall portion is between two circular arc portions and each circular arc portion is between two straight line wall portions, and at least one of the straight line wall portions of a least one of the scroll members having a recess therein in which a catalyst material resides for treatment of the compressible medium during the compression or expansion thereof.

11. The scroll compressor of claim 10 further comprising said recess having a greater size than the size of the catalyst material so that the compressible medium expands into contact with the catalyst material.

12. A scroll type compressor comprising: first and second scroll members, each having an end plate and a scroll wall projecting from the end plate, said scroll members being interleaved with one another to define therebetween a compression chamber and upon relative orbiting movement between the scroll members the compression chamber migrates to compress a gas or fluid medium; said scroll walls each being comprised of a plurality of alternating straight line wall portions and circular arc portions, each of said scroll members having a first scroll half and a second scroll half, and each of the scroll halves having the straight line wall portions thereof provided with a male member on one of the scroll halves that slides within a female slot of the other scroll half so that each of the opposing straight line wall portions is telescopically extendible in length so that the shape of the scroll members is extended in length.

13. A scroll type compressor comprising: first and second scroll members, each having an end plate and a scroll wall projecting from the end plate, said scroll members being interleaved with one another to define therebetween a compression chamber and upon relative orbiting movement between the scroll members the compression chamber migrates to compress a gas or fluid medium; said scroll walls each being comprised of a plurality of alternating straight line wall portions and circular arc portions so that each straight line wall portion is between two circular arc portions and each circular arc portion is between two straight line wall portions, and an auxiliary port provided in at least one of the straight line wall portions to enable the introduction or withdrawal of compressible medium or other materials.

* * * * *